US006358024B1

(12) United States Patent
Djordjevic

(10) Patent No.: US 6,358,024 B1
(45) Date of Patent: Mar. 19, 2002

(54) HIGH CAPACITY SUPPLY PUMP WITH SIMULTANEOUS DIRECTLY ACTUATED PLUNGERS

(75) Inventor: Ilija Djordjevic, East Granby, CT (US)

(73) Assignee: Stanadyne Automotive Corp., Windsor, CT (US)

( * ) Notice: Subject to any disclaimer, the term of this patent is extended or adjusted under 35 U.S.C. 154(b) by 0 days.

(21) Appl. No.: 09/623,124

(22) PCT Filed: Feb. 25, 1999

(86) PCT No.: PCT/US99/04115

§ 371 Date: Aug. 25, 2000

§ 102(e) Date: Aug. 25, 2000

(87) PCT Pub. No.: WO99/43957

PCT Pub. Date: Sep. 2, 1999

Related U.S. Application Data

(60) Provisional application No. 60/076,373, filed on Feb. 27, 1998.

(51) Int. Cl.[7] ..... F04B 19/00; F02M 41/00

(52) U.S. Cl. ..... 417/487; 417/565; 123/450

(58) Field of Search ..... 123/450, 451; 417/486, 487, 488, 565

(56) References Cited

U.S. PATENT DOCUMENTS

| | | | | |
|---|---|---|---|---|
| 3,961,861 A | | 6/1976 | Mowbray | 417/265 |
| 4,201,170 A | * | 5/1980 | Overfield | 123/139 BD |
| 4,624,231 A | * | 11/1986 | Fenne | 123/450 |
| 4,767,288 A | * | 8/1988 | Straubel | 417/462 |
| 5,215,449 A | | 6/1993 | Djordjevic | 417/462 |
| 5,244,354 A | | 9/1993 | Nicol | 417/219 |

OTHER PUBLICATIONS

International Search Report—1 page.

* cited by examiner

*Primary Examiner*—Charles G. Freay
(74) *Attorney, Agent, or Firm*—Alix, Yale & Ristas, LLP

(57) ABSTRACT

A high pressure fuel supply pump comprising a housing (102) and a pump body (108) fixed within the housing along a body axis and including a plurality of radially oriented plunger bores (20), each bore having a plunger (22) disposed therein. An actuating assembly (116) is disposed around the plunger bores for producing reciprocal motion. A central cavity (120) extends along the axis and intersects the pumping bores to form a pumping chamber (18) in cooperation therewith. An inlet check valve (132) and a discharged check valve (124) are in communication with the pumping chamber.

15 Claims, 8 Drawing Sheets

HIGH CAPACITY SUPPLY PUMP WITH SIMULTANEOUS DIRECTLY ACTUATED PLUNGERS

This application claims the benefit under 35 USC §119 (e) of U.S. Provisional Application 60/076,373 filed Feb. 27, 1998.

BACKGROUND OF THE INVENTION

The present invention relates to high pressure hydraulic pumps, and particularly to pumps for supplying diesel fuel at high pressure in a fuel injection system for vehicles.

Rotary hydraulic pumps for use in diesel fuel injection systems for internal combustion engines, have been well known for a number of years. Recently, desired improvements in fuel efficiency and emissions control, have led the automotive industry toward development of so-called common rail fuel injection systems, whereby a high pressure pump is utilized to establish and maintain a high fuel pressure in an accumulator in fluid communication with individual injectors. Individual injection events are controlled at the injectors for achieving combustion in the individual combustion chambers of the internal combustion engine. This is in contrast to the more common distributor type fuel injection pumps, whereby fuel pulses are distributed from within the pump, to individual distribution paths leading to a respective plurality of injectors.

Common rail pumps are expected to operate at about 20,000 psi, whereas conventional distributor pumps operate at less than about 10,000 psi. This difference accentuates certain drawbacks in conventional pumps, such as an excessive amount of fuel that experiences pressurization in connection with the pumping action, and the excessive amount of heat carried by fuel which pressure pumping, but which is not actually injected into the combustion chambers.

Unfortunately, many of the disadvantages of distributor type pumps in this regard, have been carried over into attempts to modify the distributor type pumps, for use in common rail systems. The problem of excess pumping and associated heat generation, arise especially in the so-called pump-spill, spill-pump-spill, and fill-spill techniques, as exemplified in commonly owned U.S. Pat. Nos. 5,215,449 and 5,688,110. The reluctance in setting aside such spill-type pumps, is that the fuel delivery requirements on the pump can vary considerably depending on, for example, whether the pump is starting from a cold condition, whether the pump is running at a sustained, steady state condition, and whether acceleration is required to handle an increased load. With the spill-type pumps, a quantity of fuel is delivered to the pump in an amount greater than any necessary requirement, and spill control is utilized during pumping, to try to match the quantity discharged from the pump, with the instantaneous requirements.

Other techniques attempt to match fuel quantities delivered to the pumping chamber, with the instantaneous requirements, e.g., pre-metering based on computations of pump demand by an electronic control unit (ECU). This pre-metering of the fuel quantity to be charged into the pumping chamber is typically controlled by a solenoid valve responsive to a control signal from the ECU. A major disadvantage of solenoid-implemented pre-metering, is the relatively long duration required for the metering of a useful quantity of fuel through the solenoid valve, and the difficulty to adjust the metered quantity over a wide range according to the needs of the engine. In many instances, the intake phase of pumping chamber operation with pre-metering, would not leave sufficient time to implement the pumping phase using a cam pumping rate profile shallow enough to assure quiet operation. Even with dual-rate pumping profiles, there is not enough time available during the pumping phase of a cycle, to incorporate such duality.

Another consideration which leads to significant disadvantages in the use of conventional distributor pumps for common rail injection systems, is the relatively long fuel flow paths associated with feed and discharge phases of operation.

SUMMARY OF THE INVENTION

It is, therefore, an object of the present invention to provide a high-pressure hydraulic pump which minimizes the quantity of fuel charged in the pumping chamber during the intake phase of operation, is highly energy efficient during steady state pumping operation, yet in the preferred embodiment can respond quickly to transients, such as acceleration.

It is another object, notwithstanding the nature of the manner in which fuel is fed to the pump, that the flow passages within the pump minimize dead volume and provide for highly efficient charging and discharging valve operation.

The objects set forth above are satisfied according to the present invention, by a cam having an internal actuation profile for the simultaneous inward actuation of a plurality of pumping plungers, whereby the fuel is pressurized in a substantially common, central pumping chamber, from which the high pressure fuel is discharged through an outlet located substantially on the drive shaft axis.

In one aspect, the invention has a pump housing which includes a substantially cylindrical cavity in which a stationary body portion is mounted, the body including a stationary hub portion which carries the shoe and roller assemblies radially outwardly of the plunger bores. The body includes another longitudinal, central cavity, which contains a high pressure outlet fitting. An axially slidable control valve is supported within the fitting. An inlet chamber and the inlet check valve are situated along the axis of the fitting. The inlet check valve and the discharge check portion of the control valve are both located close to the plane passing through all the pumping plungers. As a result, the flow passage between the inlet check valve and the pumping chamber, and from the pumping chamber to the discharge check valve portion, are relatively short, minimizing dead volume. Furthermore, the substantially axial flow path from the discharge check valve, along the control valve and through the fitting for discharge through a single outlet at over 100 bars, provides significant efficiencies and advantages.

The invention may also be considered as a high pressure fuel supply pump, comprising a pump housing and a pump body fixed within the housing along a body axis and including a plurality of radially oriented plunger bores, each bore having a pumping plunger disposed therein for reciprocal radial motion. An actuating assembly is disposed within the housing and around the plunger bores for producing the reciprocal motion by simultaneously driving the plungers radially inwardly during a pumping phase of the operation and simultaneously retracting the plungers radially outwardly during a charging phase of operation. A central cavity extends along the axis and intersects the pumping bores to form a pumping chamber in cooperation therewith. A feed fuel supply train includes an inlet check valve biased to open and fluidly expose the plunger bores to a supply of feed fuel at a relatively low pressure during the charging phase of operation and to seal against the supply of feed fuel during the pumping phase of operation. A high pressure outlet fitting is fixed in the central cavity and includes an internal valve cavity in fluid communication with the pumping chamber and extending along the axis. A discharge check valve is biased to seal the valve cavity from the pumping chamber while the inlet check valve opens to deliver low pressure fuel to the pumping bores during the charging phase of operation and to fluidly expose the valve cavity to the pumping chamber during the pumping phase of operation. In this manner, during the pumping phase of operation, high pressure fuel is discharged from the pumping chamber through the outlet fitting substantially along the axis.

The preferred implementation includes the steps of pre-metering successive quantities of fuel from a reservoir to a positive displacement transfer pump, then actuating the transfer pump to raise the pressure of the successive quantities of fuel by at least about 100 psi, preferably 200–300 psi. Each quantity of fuel which was pressurized in the transfer pump, is delivered to a high pressure pumping chamber defined in part by a plurality of fluidly interconnected high pressure pumping bores, so that each pumping bore receives a certain, i.e., predetermined, charge of fuel within a first time interval. A plurality of plungers in the respective pumping bores are then simultaneously actuated to increase the pressure in the pumping chamber to the desired high pressure, preferably at least about 15,000 psi, within a second time interval, and discharge the quantity of fuel through a high pressure discharge valve. The second time interval is of longer duration than the first time interval. The first time interval can be relatively short, because the pumping chamber is charged by the transfer pump at a pressure of at least about 100 psi, which is considerably higher than the conventional charging pressure. As a result, the necessary quantity of fuel can be delivered to the pumping chamber in a relatively short time period. Therefore, each pumping plunger can be actuated by a dual rate cam profile over a relatively long time period such that at steady state the actuation occurs only along a relatively shallow slope of the cam profile, whereas when acceleration is required, the actuation can occur more quickly, along a steeper profile, before continuing along the relatively shallow profile.

BRIEF DESCRIPTION OF THE DRAWINGS

These and other objects and advantages of the invention will be described in greater detail below with reference to the accompanying drawings, in which.

DESCRIPTION OF THE PREFERRED EMBODIMENT

Figure 1:
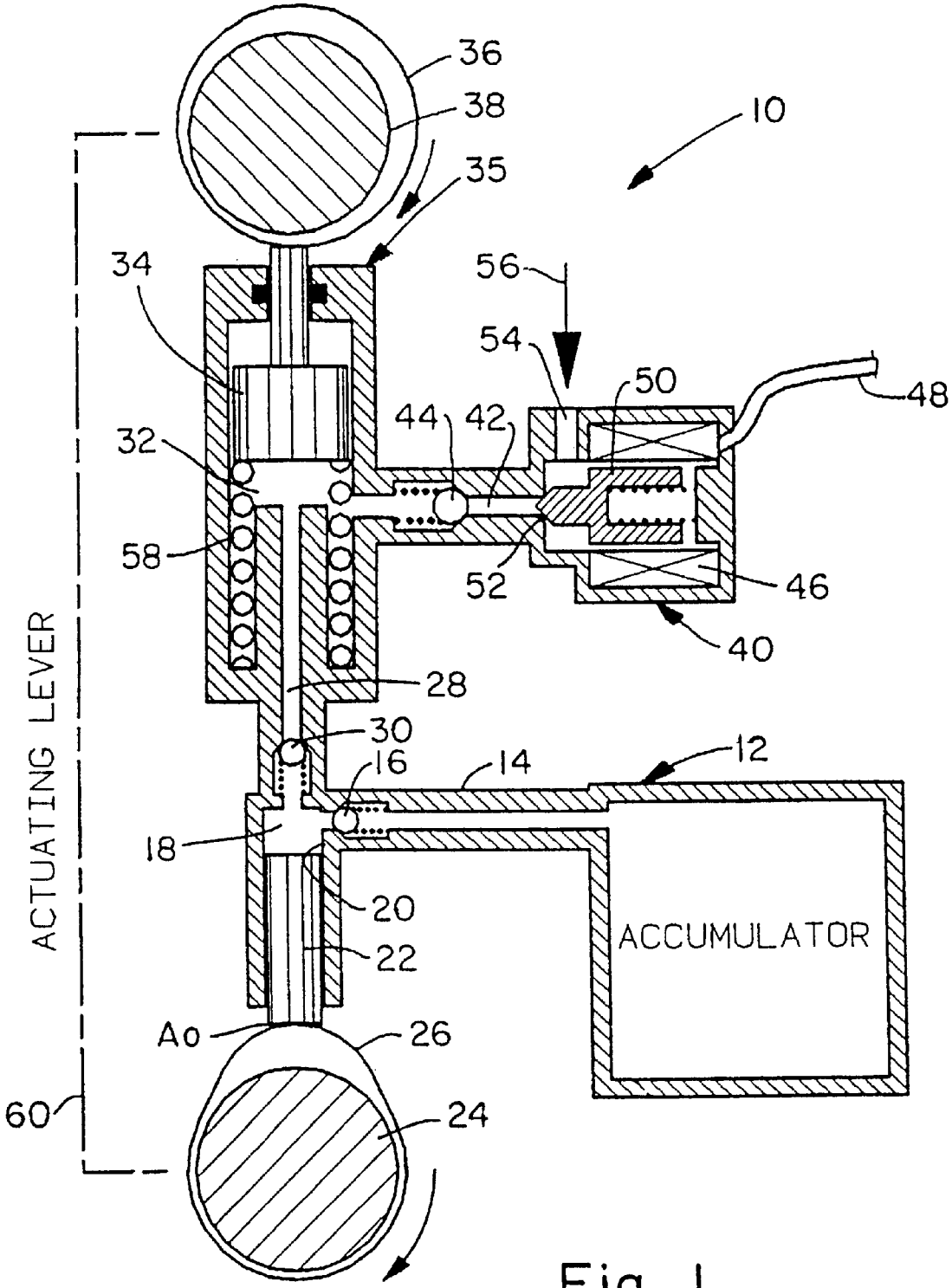
FIG. 1 is a schematic of a portion of a common rail fuel injection system incorporating one embodiment of the high pressure pump assembly of the present invention.

FIG. 1 shows schematically the essence of the operating principle of a high pressure fuel supply system 10, according to the present invention. In the illustrated embodiment, the system 10 is arranged to supply high pressure fluid, such as diesel fuel, to an accumulator 12, for ultimate injection into a diesel engine (not shown). In such a so-called common rail fuel injection system, the accumulator pressure must be maintained at about 20,000 psi, even as the fuel is continually injected from the accumulator 12 into a plurality, e.g., four, six, or eight, engine cylinders.

High pressure fuel is delivered via line 14 through check valve 16, from the pumping chamber 18. The chamber 18 is formed at least in part by a bore 20 in which a pumping plunger 22 can reciprocate, in a manner well known in this field of technology. The plunger is directly driven by a rotating cam 24 having a cam profile 26. While the plunger retracts, thereby enlarging the available volume in pumping chamber 18, fuel is supplied via inlet passage 28 through check valve 30. When the plunger 22 advances, the fuel in chamber 18 is delivered to the accumulator 12.

Fuel is supplied through the inlet passage 28 at a pressure preferably in the range of about 200–300 psi, into high pressure pumping chamber 18, by a positive displacement transfer pump 35, preferably including a transfer pumping chamber 32 and associated pumping plunger or piston 34. In practice, and as described more fully below, the system 10 would have a high pressure pumping chamber 18 formed by a plurality of pumping plungers and their respective bores, but only a single transfer pumping chamber 32 adapted to supply all the high pressure pumping bores. The transfer pump piston 34 is driven directly by a rotating cam 38 having a cam profile 36 which is different from, but has a pre-established timing relationship with, the cam profile 26.

The fuel supplied to the transfer pump chamber 32 via passage 42 through check valve 44, can be pre-metered, such as by a solenoid driven valve 40. Electromagnet 46 is energized or de-energized via leads 48, to retract or advance valve member 50, away from or against valve seat 52. This admits or blocks the flow of fuel from the low pressure supply line 56 from the fuel tank supply pump (not shown), through passage 54 into passage 42. This fuel is typically at a pressure of less than about 20 psi, preferably 10–15 psi. The fuel supply at this low pressure can be considered a reservoir.

The valve 40 is relatively slow in operation, but as a consequence, is relatively accurate in the quantity of fuel that can be metered into chamber 32. The quantity of metered fuel from valve 40 can be regulated according to the demand on the engine, e.g., during acceleration, in a well known manner. (For example by an ECU such as described in U.S. Pat. No. 5,103,792, "Processor Based Fuel Injection Control System", the disclosure of which is hereby incorporated by reference.) The volume of the chamber 32 and the pre-load on the associated piston return spring 58, assure that any potentially desirable quantity of metered fuel can be received in chamber 32 for delivery through passage 28.

Regardless of the specific manner of supplying feed fuel to the pumping chamber, the components and flow paths which perform this function can be collectively referred to as a feed supply train.

The cam 24 and cam 38 are in rigid, fixed relation to each other, forming an actuating lever 60 which automatically coordinates the phasing of the relationship between the plunger 22 and the piston 34. Such phasing can be understood with reference to FIGS. 2 and 3. The upper portions of FIGS. 2 and 3 represent the transfer pump chamber 32 and piston 34 as controlled by cam profile 36, whereas the lower portions represents the high pressure pumping chamber 18 and plunger 22 as controlled by cam profile 26.

Point A on the profile 26 corresponds to the cam nose, or peak displacement of plunger 22, at zero rotation angle of cam 24, and point B on the profile 36 corresponds to the minimum displacement of piston 34 at zero rotation angle of cam 38. The complete cycle of one profile 26 from A to Al and one profile 36 from B to B1, is represented along a scale of zero to 100 per cent. As the piston 34 follows the upslope of portion 62 of profile 36, the fuel in chamber 32 is discharged into the chamber 18, because the plunger 22 is retracting as it follows the downslope of cam portion 64. The charge of fuel delivered to chamber 18 is thus commensurate with (and preferably equal to) the pre-metered quantity to chamber 32. During steady state operation, the quantity of fuel in chamber 32 delivered to chamber 18, only partially fills chamber 18, as shown at 40 per cent scale. Chamber 18 does not fully expand, but rather reaches an intermediate limit at about 20 per cent scale (point 76), and remains at that limit until just past 60 per cent scale. The downslope, minimum, and upslope portions defined by segments 76 to 66; 66 to 68; and 68 to 78 do not influence the fuel volume ultimately charged in the chamber 18. At point 78, the plunger 22 advances through chamber 18 to develop the high pressure for delivery to the accumulator 12.

As the piston 34 follows the downslope portion 61 of cam profile 36, the chamber 32 expands to receive the metered supply of fuel via valve 40. This quantity is delivered during a relatively long period of time during which the high pressure plunger 22 is delivering fuel from the chamber 18 to accumulator 12, as a result of the upslope on portion 74 of profile 26. The quantity of fuel supplied to chamber 32 is calculated by an on-board computer or regulator (not shown) depending on the desired fuel delivery to the engine and the desired accumulator pressure. The maximum displacement of the transfer pump piston 34 is slightly smaller than the maximum displacement of the high pressure plunger 22 (e.g., 10 per cent less) in order to avoid hydraulic lock and to protect the pump components from mechanical overstress.

Figure 2:
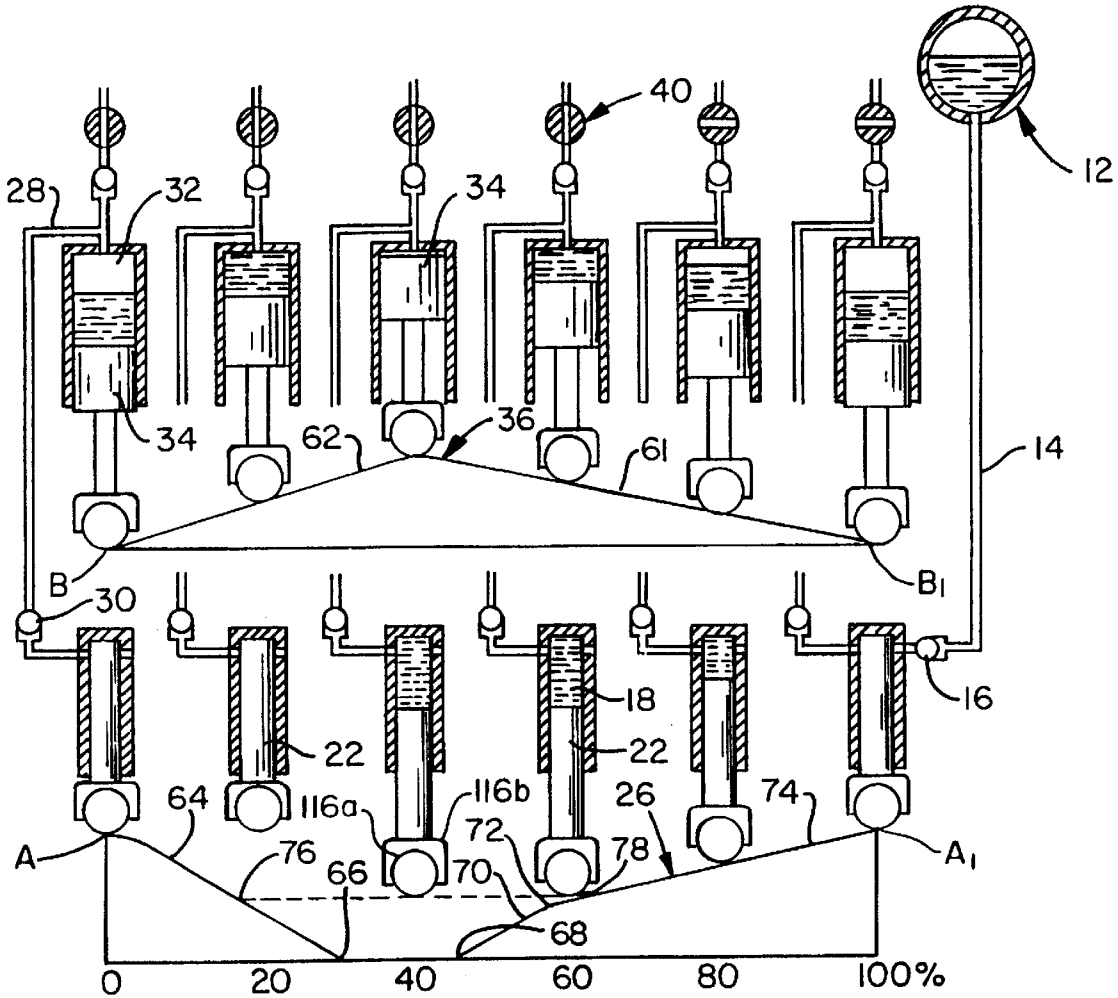
FIG. 2 is a schematic of the interaction of the transfer pump and high pressure pump for the timing of maximum fuel delivery during steady state operation and constant accumulator pressure.
Figure 3:
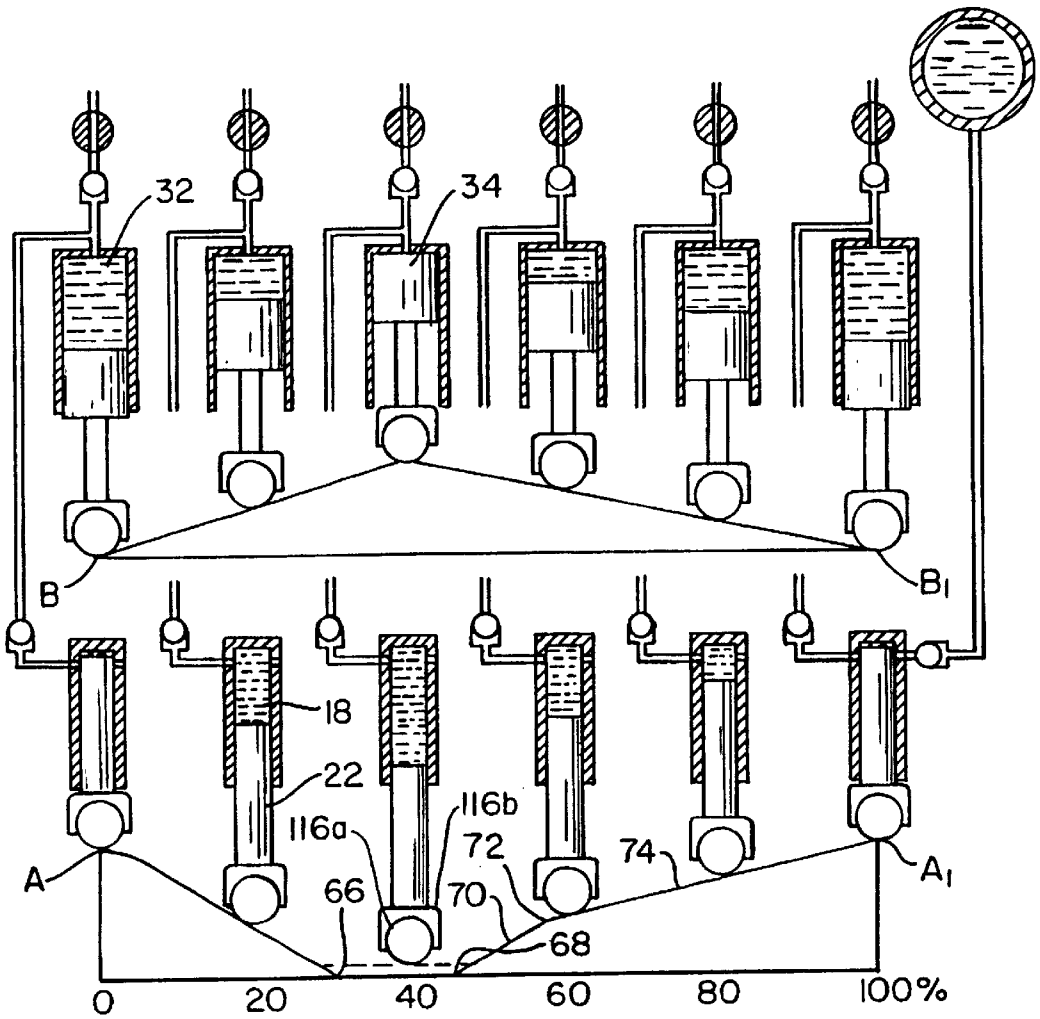
FIG. 3 is a schematic of the interaction of the transfer pump and high pressure pump for the timing of maximum fuel delivery during transient operation and simultaneous accumulator pressure increase.

It can be appreciated from FIGS. 1 and 2, that the normal pumping rate of cam profile 26 is relatively low (i.e., a gradual and relatively long upslope 74 along almost 40 per cent of scale), which minimizes both hydraulic and acoustic noise. This has been achieved because the necessary quantity of fuel is delivered to the pumping chamber 18, over a relatively short time period (i.e., during less than about 20 per cent of scale on the steep downslope 64).

In the preferred implementation, an inexpensive, easily controlled transfer pump arrangement is capable of delivering a metered quantity at high pressure over a short time interval. The quantity is controllable by the use of an inexpensive valve 40, because the time available for metering quantity, is relatively long, i.e., the full length of profile 61. Yet the metered quantity can be delivered to charge chamber 18 at a pressure of, for example, 200–300 psi, thus requiring only a short delivery time interval. This is in contrast to conventional transfer pumps, which typically operate at less than about 15 psi, and thus require a considerably longer time interval to charge the same quantity.

The capability to charge the high pressure pumping chamber 18 during a short interval (e.g., within about 10–20 per cent of scale rotation of cam 26 for steady state operation), not only permits the use of a long, gradually ascending profile 74 for the driving of the high pressure plunger 22, but further permits accommodation of a dual ascending rate. This is shown in FIG. 2, as a short, rapidly rising profile 70, between points 68 and 72, followed by the longer, lower rate portion 74. The slope of profile portion 70 is preferably at least twice as steep as that of profile portion 74. During steady state, the chamber 18 does not completely fill, so the high rate portion 70 is not utilized. This is represented by the dashed line extending between points 76 and 78, whereby the plunger 22 "floats" for a duration of about 40 per cent scale.

During demand for faster accumulator pressure increase associated with acceleration, the valve 40 admits a higher quantity of fuel to chamber 32, which corresponds to a longer duration on portion 64 of profile 26, almost to point 66, thereby nearly filling chamber 18. This situation is explained with respect to FIG. 3. The plunger 22 then floats along a "flat" transition profile between 66 and 68, before quickly rising along portion 70 and then continuing the pumping action along the "steady state" slope 74 between points 72 and A1. The portion 70 used for acceleration, preferably spans a duration of about 10–15 per cent of scale. Even in the transient operation depicted in FIG. 3, the plunger 22 floats for a duration of about 20 per cent scale, on an oil film indicated at the arrows. The plunger 22 thus releases the cam force loading the shoe 116*b* for a certain time period to allow the roller 116*b* to replenish the oil film inside of the shoe. Preferably, the volumetric charging rate into chamber 22 is at least 50% faster than the acceleration pumping rate due to cam profile portion 70.

The point 78 at which the roller begins the pumping phase on profile 26 by actuating plunger 22 inwardly, depends on the volume of fuel transferred from chamber 32 into the pumping chamber 18. This volume is commensurate with, and preferably substantially equal to, the volume of fuel metered by valve 40 during the intake stroke of piston 34 along transfer cam portion 61. The charge of fuel delivered by the piston stroke along cam portion 62 through path 28, is predictably allocated in the pumping chamber so each of the plunger bores receives approximately the same amount of fuel during charging.

Figure 4:
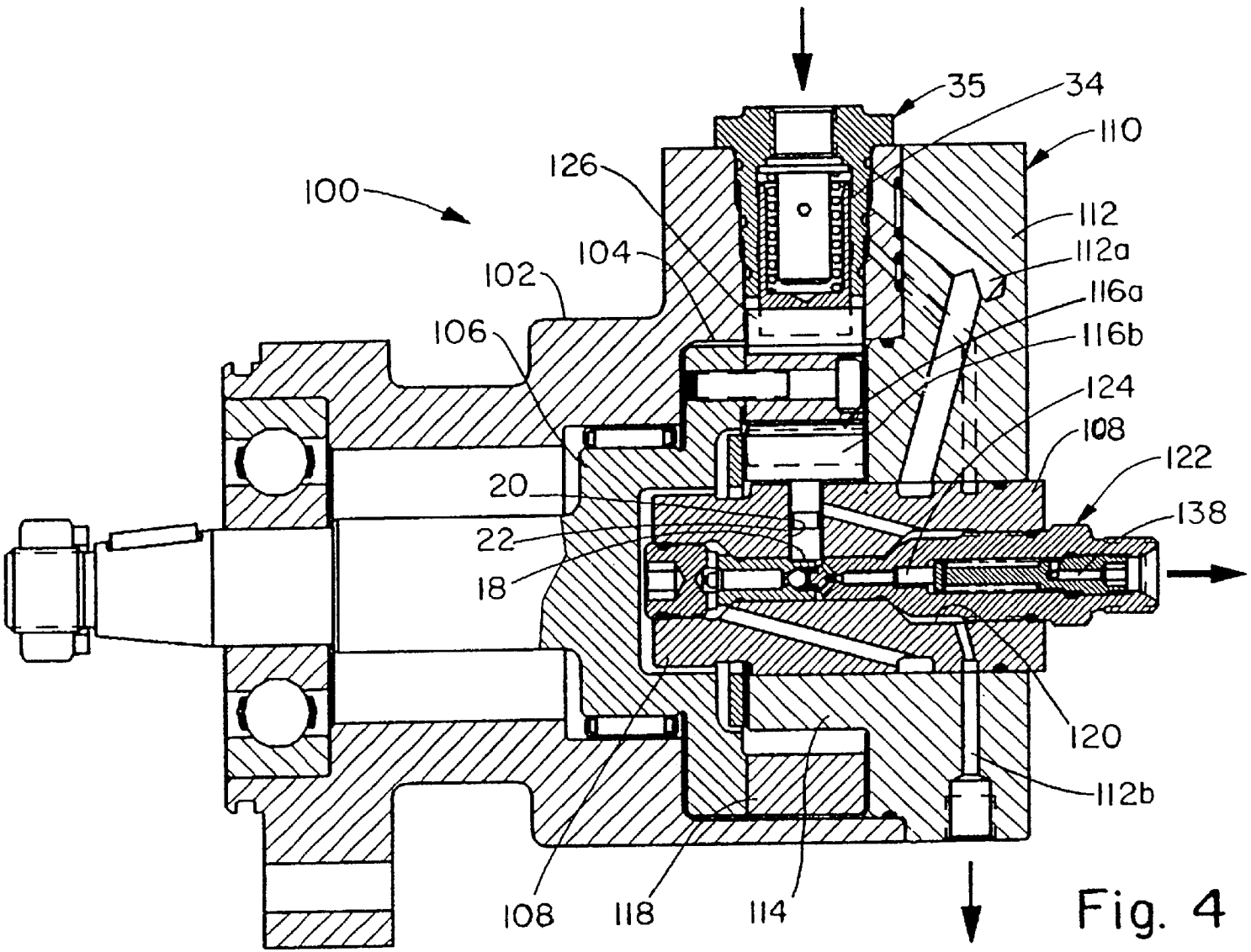
FIG. 4 is a longitudinal section view of a common rail supply pump assembly for implementing the features shown schematically in FIGS. 1–3.
Figure 5:
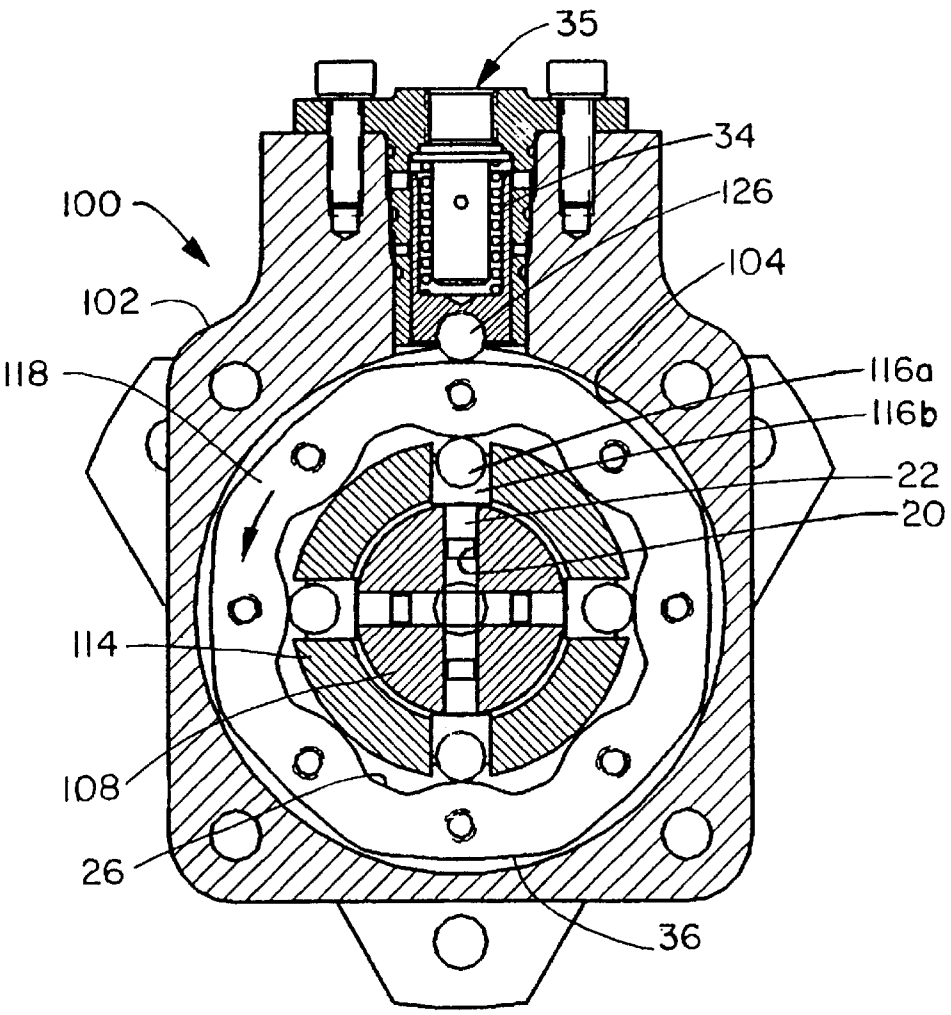
FIG. 5 is an illustrative cross section view of the pump shown in FIG. 4.

FIGS. 4 and 5 show longitudinal and cross sectional views of a preferred embodiment 100 for implementing the inventive features described above. A pump shaft housing 102 has a central cavity 104 in which a drive shaft 106 is supported for rotation. A stationary and rotationally fixed body 108 is situated in part within housing 102 and coaxially aligned with the shaft. Fixed head 110 is secured to housing 102 and has a low pressure fluid handling portion 112 including low pressure supply and leak off channels handling portion 112 including low pressure supply and leak off channels 112*a*, 112*b*, and a roller shoe support hub portion 114. The hub 114 lies within housing 102 and surrounds body 108. The shaft housing 102 and head 110 together can be considered as defining the housing of the pump assembly.

The associated roller assembly 116 is situated concentrically inside the cam ring 118, which rotates as a result of fixation to the shaft 106. Four radially extending, orthogonally oriented bores 20 in the body 108 contain a respective four reciprocable plungers 22 which cause the respective pumping volumes to expand and contract. The pumping chamber 18 is formed at the intersection of the bores 20 in central cavity 120 of body 108. It should be understood that the pumping chamber as shown is a volume defined cooperatively by portions in the central cavity and inner ends of the bars, that is pressurized by the simultaneous actuation of the plungers. A high pressure outlet fitting 122 is fixedly supported within the cavity 120, and an axially slidable control valve 124 is supported within the fitting 122. The cam ring 118 surrounds the pumping plungers 22 and, in a manner well known in this field, a cam pumping profile 26 along the inner circumference of the ring, cooperates with cam rollers 116*a*, and associated shoes 116*b*, to reciprocate the plungers 22. This overall arrangement is analogous to that described in U.S. Pat. Nos. 5,215,449 issued Jun. 1, 1993, U.S. Pat. No. 5,688,110 issued Nov. 18, 1997 (the disclosure of which is hereby incorporated by reference).

The outer circumference of the cam ring 118 also provides a cam profile 36, for maintaining rolling contact with an outer roller 126 which causes reciprocation of the piston 34 in the transfer pump 35. The cam ring as shown in FIG. 5, is rotatable counterclockwise and is depicted at the "zero" angle of rotation on the scale for profile 26, wherein the high pressure pumping roller 116*a* is on the nose of the pumping profile, corresponding to point A in FIG. 2. The transfer roller 126 is at the lowest point B of the cam profile 36 as shown in FIG. 2. Rotation of the cam ring until point A1 arrives at the former location of point A, corresponds to one pumping cycle. The total travel ways, for example, as "100 per cent of a pumping cycle", or as the angular displacement of the cam ring 118 which in the illustrated embodiment is 45 degrees. Clearly, for a different number of plungers or actuation frequency, 100 per cent of a pumping cycle could correspond to a different angular displacement, such as 60 degrees or 90 degrees.

In the embodiment of FIG. 4, the roller 126 for the transfer pump is in vertical alignment with the rollers 116*a* for the high pressure pump, but this is not necessary. Furthermore, only one transfer pump 35 serves all high pressure pumping bores 20. Fuel is transferred to all pumping bores simultaneously during a relatively short portion of the pumping cycle, and thereafter all plungers 22 are driven inwardly simultaneously during a longer portion of the pumping cycle.

In general, advantageous use of the pump as described above with respect to FIGS. 1–5, can be realized within the range of parameters shown in Table 1:

TABLE 1

| Feature | Scale Duration | Numeric ID |
|---|---|---|
| Transfer Cam Profile | 100 percent | 36 |
| intake portion | >50 percent | 61 |
| discharge portion | <50 percent | 62 |
| Pumping Cam Profile | 100 percent | 26 |
| nose portion | <5 percent | A |
| charging portion | 20–30 percent | 64 |
| flat portion | 10–30 percent | 66 to 68 |
| acceleration portion | 10–20 percent | 70 |
| steady state portion | 30–60 percent | 74 |

Figure 6:
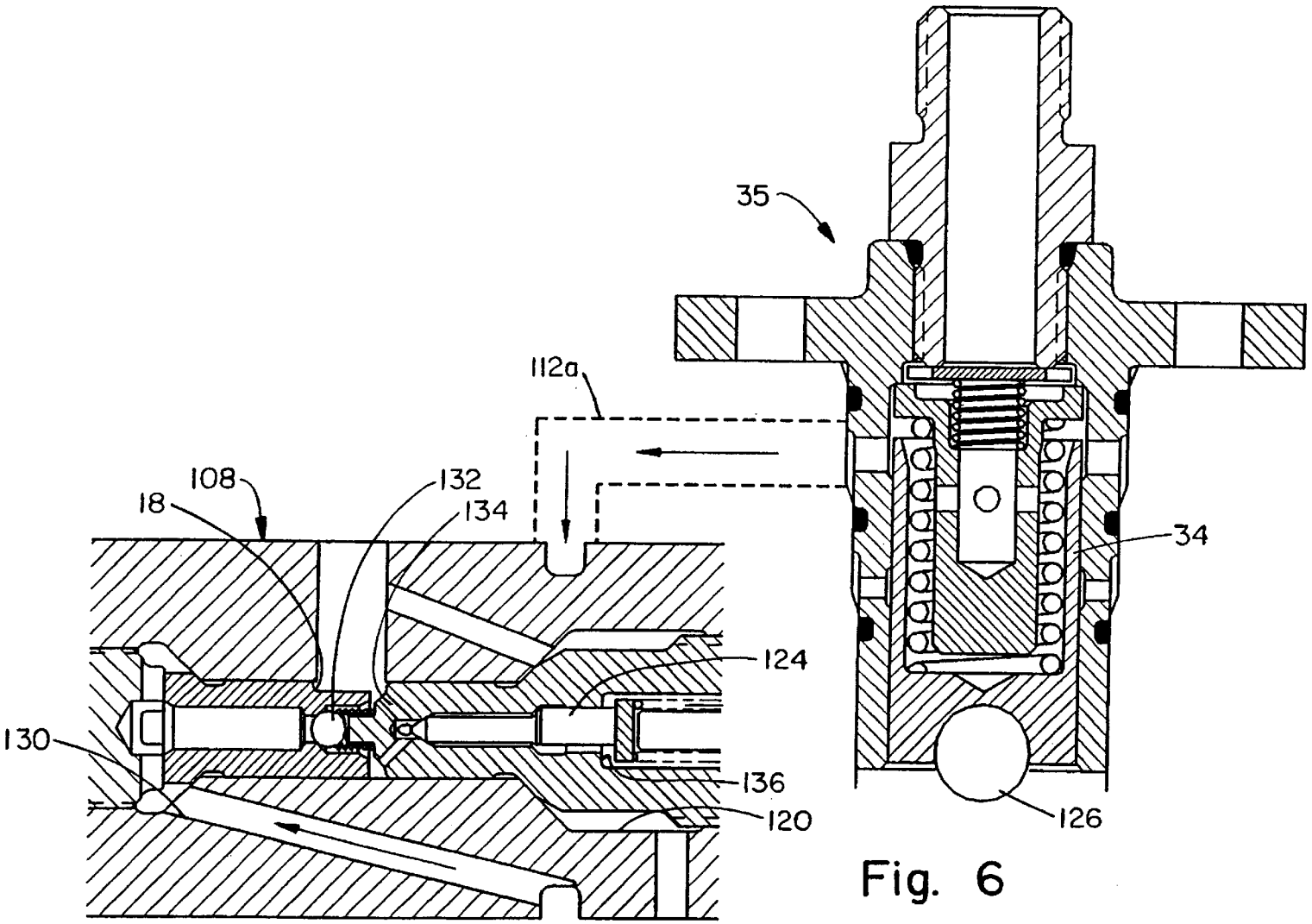
FIG. 6 is a schematic of the charging operation of the components of the pump shown in FIG. 4.

The preferred implementation of the cooperation between the transfer pump 35 and the control valve 124 for charging and discharging the high pressure pumping chamber 18, is shown schematically in FIG. 6. The transfer pump 35 is particularly well suited for rapidly transferring a metered volume of fuel to the inlet check valve 132, to charge the pumping chamber during only a short duration of the retraction of the pumping plungers 22 along cam profile portion 64 (e.g., <20 per cent of scale during steady state maximum fuel delivery, as shown in FIG. 2). Also, the transfer pump phasing offset and reduction in the number of seals between the transfer pump and the high pressure chamber permits the transfer pump itself to initially charge the accumulator to a pressure of about 200–300 psi, before the high pressure pumping takes over. This can substantially reduce the cranking time and reduce the pressurized response time whenever required for a cold engine. As shown with greater particularity in FIG. 6, the transfer pump roller 126 actuates transfer piston 34, whereby fuel is delivered via low pressure supply line 112*a*, into the exterior groove in pump body 108, whereupon the fuel is delivered via inlet passage 130 to check valve 132. Check valve 132 opens during the intake phase of pumping operation, thereby delivering fuel into the pumping chamber 18 whereupon, as the plungers (not shown in FIG. 6) are actuated radially inwardly, the inlet check valve 132 closes. The control valve 124 is normally spring biased to prevent passage of fuel through high-pressure passages 134 during the intake phase, but during the pumping phase, the valve 124 opens, so that high pressure fuel is delivered via high pressure passages 134 and valve cavity 136, to the discharge port 138 (see FIG. 4).

Figure 7:
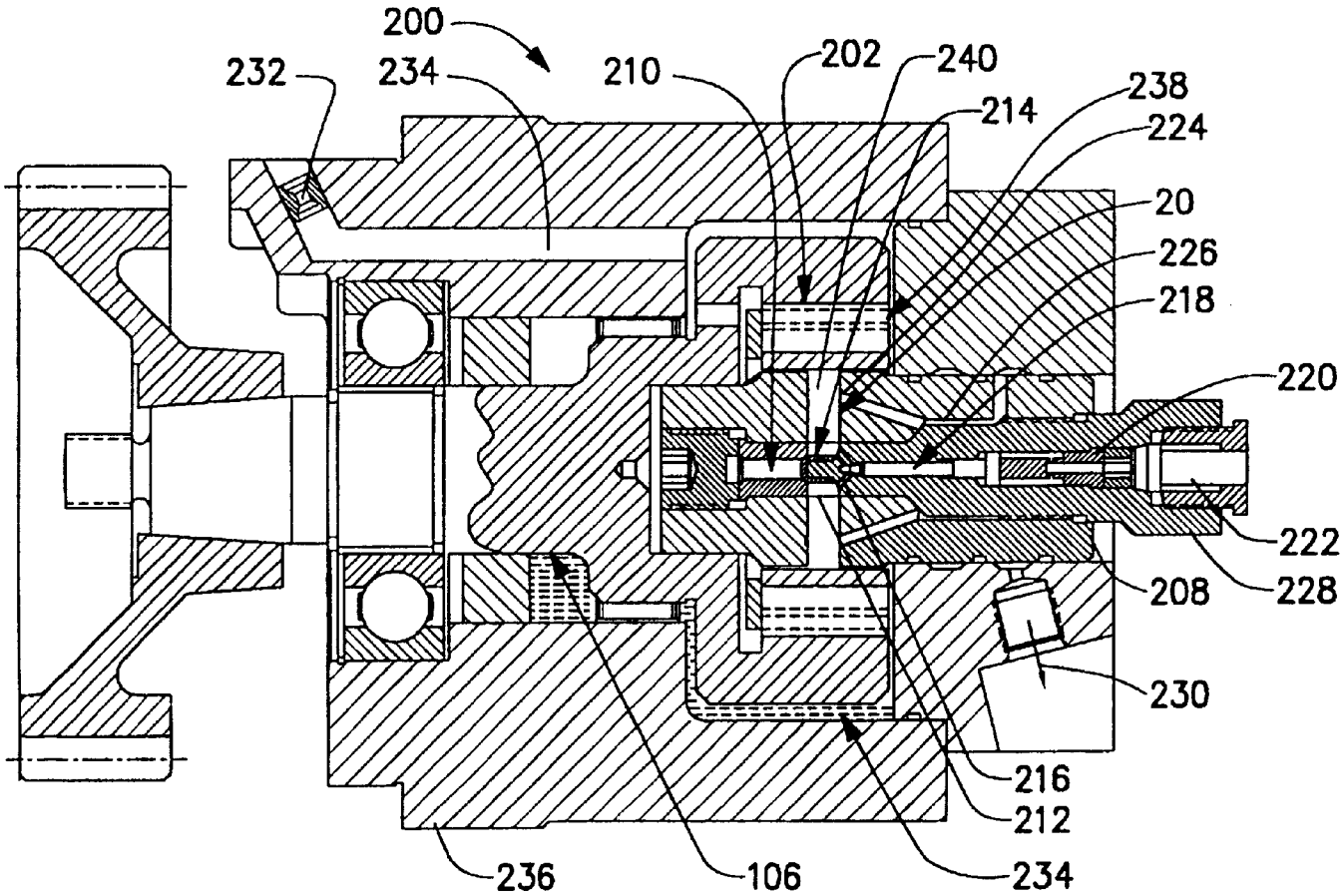
FIG. 7 is a schematic of an alternative to the pump shown in FIG. 6.
Figure 8:
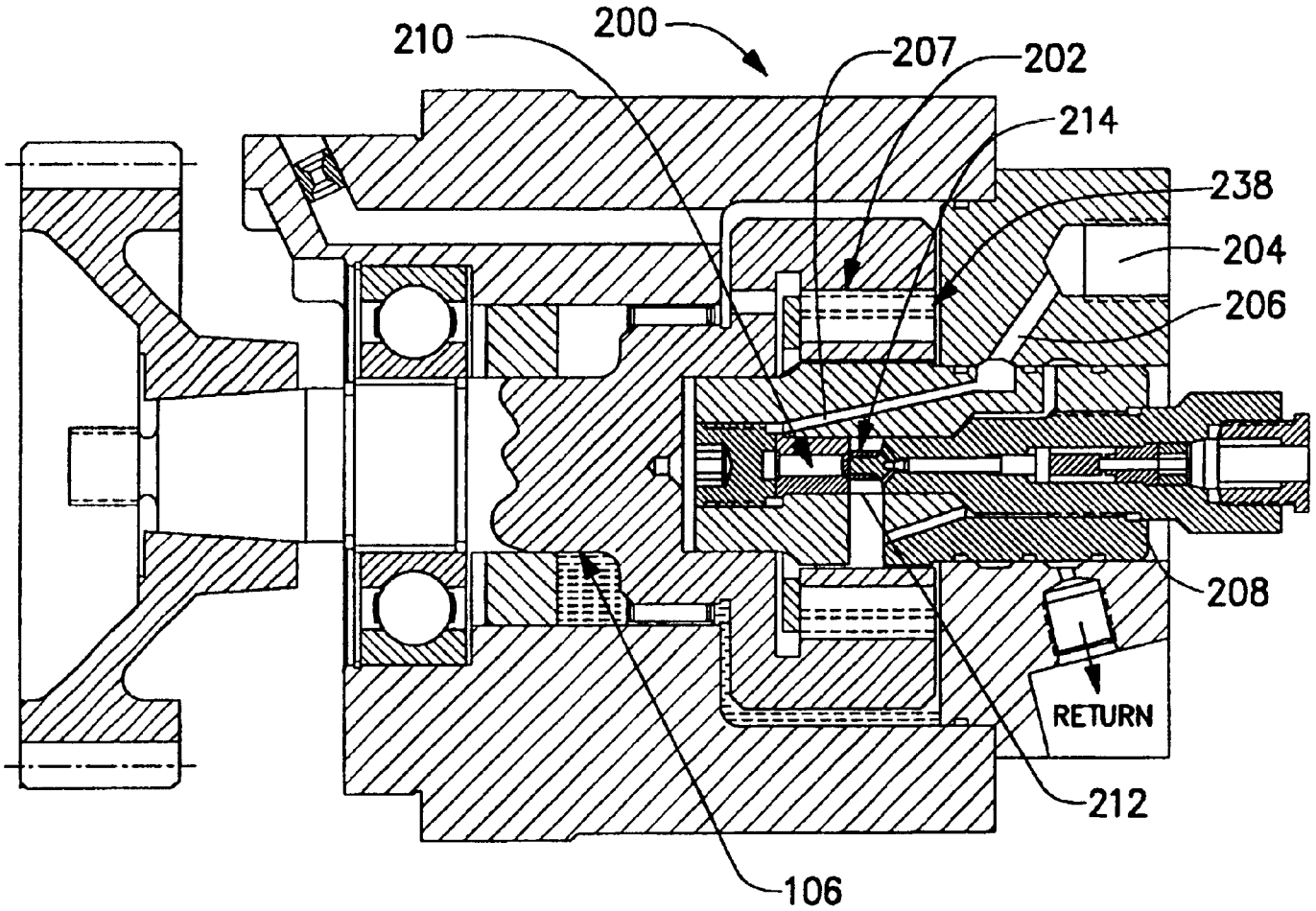
FIG. 8 is a longitudinal section view along a plane different from that shown in FIG. 7, revealing the feed path to the inlet chamber.

FIGS. 7 and 8 show another embodiment of a high pressure supply pump 200 with simultaneously directly actuated plungers, which shares many features of the pump shown in FIGS. 4–6, except that the feed technique can be different. The actuating cam 202 only has an internal cam profile, without the external profile for actuating a transfer pump. Feed fuel is delivered via modulated pressure inlet 204 through paths 206 in housing or housing cover and 207 in central body 208, to the inlet chamber 210, located on the central axis on one side of the pumping plunger plane, from which feed fuel can flow into the pumping chamber 212 upon retraction of the inlet check valve 214. During the pumping phase of operation, the fuel at high pressure leaves the pumping chamber 212 through the respective discharge passages 216 as the discharge or outlet check valve 218 opens and the inlet check valve closes. The fuel flows over the control valve 220 and is discharged from the pump housing via the outlet 222.

Leak-off grooves 224 are provided in the pumping plunger bores 20, for return of fuel via 230 to the fuel tank at low pressure. The outer surface 226 of a portion of the outlet fitting 228 is spaced from the body 208, to provide a portion of the leak-off flow path.

The simultaneous pumping permits more pumping cycles per drive shaft revolution, than is available in a sequentially actuated pump, and therefore a greater quantity of fuel can be provided at high pressure through the outlet, during a given time period.

It can be appreciated that the engine lube oil introduced through orifice 232 and delivered through path 234 in the housing 236 is utilized for lubricating the sliding surfaces of the pump, i.e., the interaction of the internal cam 202 with the shoe and roller 238 and plunger outer surfaces 240.

What is claimed is:

1. A high pressure fuel supply pump, comprising:

a pump housing;

a pump body fixed within the housing along a body axis and including a plurality of radially oriented plunger bores, each bore having a pumping plunger disposed therein for reciprocal radial motion;

an actuating assembly disposed within the housing and around the plunger bores for producing said reciprocal motion by simultaneously driving the plungers radially inwardly during a pumping phase of operation and simultaneously retracting the plungers radially outwardly during a charging phase of operation;

a central cavity extending along the axis and intersecting the pumping bores to form a pumping chamber in cooperation therewith;

a feed fuel supply train including an inlet check valve biased to open and fluidly expose the plunger bores to a supply of feed fuel at relatively low pressure during the charging phase of operation and to seal against the supply of feed fuel during the pumping phase of operation;

a high pressure outlet fitting fixed in the central cavity and including an internal valve cavity in fluid communication with the pumping chamber and extending along the axis;

a discharge check valve biased to seal the valve cavity from the pumping chamber while the inlet check valve opens to deliver low pressure fuel to the pumping bores during the charging phase of operation and to fluidly expose the valve cavity to the pumping chamber during the pumping phase of operation;

whereby during the pumping phase of operation, high pressure fuel is discharged from the pumping chamber through the outlet fitting substantially along said axis.

2. The fuel supply pump of claim 1, wherein the bores have fuel leak-off grooves which are in fluid communication with an annular space between the fitting and the body, and a low pressure fuel return line is in fluid communication with the annular space.

3. The fuel supply pump of claim 1, wherein the pumping chamber within the central cavity is substantially annular and a plurality of discharge passages lead from the pumping chamber to the valve cavity, where the discharge sealing is performed by a single axially movable valve against all said discharge passages.

4. A high pressure fuel supply pump, comprising:

a pump housing;

a pump body fixed within the housing along a body axis and including a plurality of radially oriented plunger bores, each bore having a pumping plunger disposed therein for reciprocal radial motion;

an actuating assembly disposed within the housing and around the plunger bores for producing said reciprocal motion by simultaneously driving the plungers radially inwardly during a pumping phase of operation and simultaneously retracting the plungers radially outwardly during a charging phase of operation;

a central cavity in the body extending along the axis and intersecting the pumping bores to form a pumping chamber in cooperation therewith;

a feed fuel supply train including an inlet check valve biased to open and fluidly expose the plunger bores to a supply of feed fuel at relatively low pressure during the charging phase of operation and to seal against the supply of feed fuel during the pumping phase of operation;

a high pressure outlet fitting fixed in the central cavity and including an internal valve cavity in fluid communication with the pumping chamber and extending along the axis;

a discharge control valve slidable in the valve cavity and biased to seal the valve cavity from the pumping chamber while the inlet check valve opens to deliver low pressure fuel to the pumping bores during the charging phase of operation and to fluidly expose the valve cavity to the pumping chamber during the pumping phase of operation;

whereby during the pumping phase of operation, high pressure fuel is discharged from the pumping chamber through the outlet fitting substantially along said axis.

5. The fuel supply pump of claim 4, wherein the control valve includes an internal passage in fluid communication with the valve cavity, for delivering fuel for discharge through the outlet fitting.

6. The fuel supply pump of claim 4, wherein the bores have fuel leak-off grooves which are in fluid communication with an annular space between the fitting and the body, and a low pressure fuel return line is in fluid communication with the annular space.

7. The fuel supply pump of claim 4, wherein the pumping chamber within the central cavity is substantially annular and a plurality of discharge passages lead from the pumping chamber to the valve cavity, where the discharge sealing is performed by a single axially movable valve against all said discharge passages.

8. A high pressure fuel supply pump, comprising:

a pump housing;

a pump body fixed within the housing along a body axis and including a plurality of radially oriented plunger bores, each bore having a pumping plunger disposed therein for reciprocal radial motion;

an actuating assembly disposed within the housing and around the plunger bores for producing said reciprocal motion by simultaneously driving the plungers radially inwardly during a pumping phase of operation and simultaneously retracting the plungers radially outwardly during a charging phase of operation;

a central cavity in the body extending along the axis and intersecting the pumping bores to form a pumping chamber in cooperation therewith;

an inlet chamber situated in the central cavity on one side of the pumping chamber, in fluid communication with a supply of relatively low pressure feed fuel;

an inlet check valve situated in the central cavity between the inlet chamber and the pumping chamber, and biased to open and fluidly expose the plunger bores to the inlet chamber during the charging phase of operation and to seal the inlet chamber from the pumping chamber during the pumping phase of operation;

a high pressure outlet fitting fixed in the central cavity on the other side of the pumping chamber and including an internal valve cavity in fluid communication with the pumping chamber and extending along the axis;

a discharge control valve slidable in the valve cavity and biased to seal the valve cavity from the pumping chamber while the inlet check valve opens to deliver low pressure fuel from the inlet chamber through the pumping chamber to the pumping bores during the charging phase of operation and to fluidly expose the valve cavity to the pumping chamber and plunger bores during the pumping phase of operation;

whereby during the pumping phase of operation, high pressure fuel is discharged from the pumping chamber through the outlet fitting substantially along said axis.

9. The fuel supply pump of claim 8, wherein the control valve includes an internal passage in fluid communication with the valve cavity, for delivering fuel for discharge through the outlet fitting.

10. The fuel supply pump of claim 8, wherein the bores have fuel leak-off grooves which are in fluid communication with an annular space between the fitting and the body, and a low pressure fuel return line is in fluid communication with the annular space.

11. The fuel supply pump of claim 8, wherein the pumping chamber within the central cavity is substantially annular and a plurality of discharge passages lead from the pumping chamber to the valve cavity, where the discharge sealing is performed by a single axially movable valve against all said discharge passages.

12. A high pressure fuel supply pump, comprising:

a pump housing;

a substantially cylindrical, stationary pump body fixed within the housing and extending along a longitudinal axis and including a plurality of radially oriented plunger bores having center lines lying in a common pumping plane, each bore having a pumping plunger disposed therein for reciprocal radial motion;

an actuating assembly disposed within the housing and around the plunger bores for producing said reciprocal motion by driving the plungers radially inwardly during a pumping phase of operation and retracting the plungers radially outwardly during a charging phase of operation;

an axially elongated central cavity situated within and centered on the longitudinal axis of the body, in fluid communication with the pumping bores;

an inlet chamber situated in the central cavity on one side of the pumping plane, in fluid communication with a supply of relatively low pressure feed fuel;

an inlet check valve situated in the central cavity between the inlet chamber and one side of the pumping plane, and biased to open and fluidly expose the plunger bores to the inlet chamber during the charging phase of operation and to seal the inlet chamber from the plunger bores during the pumping phase of operation;

a high pressure outlet fitting fixed in the central cavity on the other side of the pumping plane and including an internal valve cavity in fluid communication with the pumping bores and extending longitudinally along the central axis;

a discharge control valve slidable in the valve cavity and biased to seal the valve cavity from the plunger bores while the inlet check valve opens to deliver low pressure fuel from the inlet chamber to the pumping bores during the charging phase of operation and to expose the valve cavity to the plunger bores during the pumping phase of operation;

whereby during the pumping phase of operation, high pressure fuel is discharged through the outlet fitting substantially along said axis.

13. The fuel supply pump of claim 12, wherein the bores have fuel leak-off grooves which are in fluid communication with an annular space between the fitting and the body, and a low pressure fuel return line is in fluid communication with the annular space.

14. The fuel supply pump of claim 12, wherein the pumping chamber within the central cavity is substantially annular and a plurality of discharge passages lead from the pumping chamber to the valve cavity, where the discharge sealing is performed by a single axially movable valve against all said discharge passages.

15. The fuel supply pump of claim 12, wherein the control valve includes an internal passage in fluid communication with the valve cavity, for delivering fuel for discharge through the outlet fitting.

* * * * *